United States Patent [19]

Craig et al.

[11] 4,072,865

[45] Feb. 7, 1978

[54] AUTOMATIC CONTROL SYSTEM

[75] Inventors: James R. Craig, Glenview; Steven F. Nerge, Elgin, both of Ill.

[73] Assignee: American Radiologic Systems, Inc., Melrose Park, Ill.

[21] Appl. No.: 699,444

[22] Filed: June 24, 1976

[51] Int. Cl.[2] ..... H05G 1/34; H05G 1/58

[52] U.S. Cl. ..... 250/409; 315/106; 315/307

[58] Field of Search ..... 315/106, 307, 308; 250/408, 409

[56] References Cited

U.S. PATENT DOCUMENTS

| | | | |
|---|---|---|---|
| 2,627,035 | 1/1953 | Ball | 315/106 X |
| 3,521,067 | 7/1970 | Splain | 250/408 |
| 3,916,251 | 10/1975 | Hernandez et al. | 315/106 |

*Primary Examiner*—Alfred E. Smith
*Assistant Examiner*—Charles F. Roberts
*Attorney, Agent, or Firm*—Olson, Trexler, Wolters, Bushnell & Fosse, Ltd.

[57] ABSTRACT

An automatic control system is provided for regulating the emission of an X-ray tube of the type which is activated by the heating of a cathode filament by passing current through the filament, and which emits X-ray radiation systematically in accordance with the amount of tube current flowing between the anode and cathode of the tube, with a relatively high voltage being applied between the anode and cathode. Current is passed through the filament and a tube current sensor is coupled to the X-ray tube for developing a tube current signal representative of the magnitude of the current flowing between the cathode and anode of the X-ray tube. Coupled to the current sensing circuit and responsive to the tube current signal is a circuit for generating a filament current control signal. A filament current control circuit is coupled between the filament current control signal generating means and the filament and is responsive to the filament current control signal for regulating the amount of current flowing through the filament, whereby the filament current is automatically adjusted in accordance with the magnitude of the tube current to maintain the tube current at a predetermined level.

9 Claims, 3 Drawing Figures

AUTOMATIC CONTROL SYSTEM

BACKGROUND OF THE INVENTION

This invention generally relates to X-ray apparatus and, more particularly, to a system for automatically regulating the emission of the X-ray tube during its operation as well as controlling the warm-up process.

In the operation of X-ray apparatus, it is often very desirable to maintain the X-ray tube current at a precise level because X-ray emission is directly related to the amount of current flowing between the anode and cathode of the tube. Precise control of the amount of X-ray emission is of course desirable because it is important to have the same X-ray exposure each time the apparatus is set by the equipment operator to make that exposure.

Conventional approaches to the problem of regulating X-ray tube current rely upon the concept of regulating the voltage applied to the filament circuit of the X-ray tube to control the filament current. Such voltage regulators have several drawbacks in that the amount of X-ray tube current is proportional to the temperature of the cathode filament which, in turn, is a function of both the resistance of the filament and the amount of current passing therethrough. As the filament ages, its resistance changes because a portion of the filament evaporates. Moreover, age and temperature affect the values of the circuit components supplying the voltage/current to the filament. As a result, periodic readjustment of the apparatus is required to compensate for these changes.

Another problem with conventional X-ray apparatus relates to the amount of time required to prepare the apparatus for operation and the manner in which it is accomplished. It is desirable in some procedures such as "spot filming" to change from a low emission level (fluoroscopy) to a high emission level (radiography) as quickly as possible. To heat the filament quickly it is necessary to supply a very large amount of current during the first 0.2 seconds when the filament is cold and very low in resistance. Voltage regulated systems with fixed source impedances cannot supply optimum amounts of current during the cold start, and therefore cannot start as fast as a current regulated system, such as hereinafter described.

OBJECTS AND SUMMARY OF THE INVENTION

It is therefore an object of the present invention to provide an X-ray apparatus having a new and improved system for controlling the level of emission of the X-ray tube.

It is a further object of the present invention to provide such an apparatus which automatically controls the X-ray tube current both prior to making an exposure and during the exposure itself.

It is a specific object of the invention to provide such an apparatus in which the automatic control of the X-ray tube current is achieved by controlling the current passing through the filament of the X-ray tube.

It is another object of the invention to provide such an apparatus which automatically compensates for changes due to age, temperature, and the power supply.

It is yet another object of the invention to provide such an apparatus which automatically switches in a novel manner by use of the X-ray tube current from a standby operation to an emission operation. Thus, the present invention utilizes the X-ray tube current between anode and cathode to turn on the regulator that controls the current for the filament. This is in contrast to conventional regulators in which the absence of tube current may result in an excessive supply of current to the filament, which might damage or destroy the tube.

In accordance with the invention, a new and improved automatic control system for regulating the emission of an X-ray tube of the type which is activated by the heating of cathode filament by passing current through the filament, and which emits X-ray radiation systematically in accordance with the amount of tube current flowing between the anode and cathode of the tube, with a relatively high voltage being applied between the anode and cathode, comprises circuit means for passing current through the filament and tube current sensing means coupled to the X-ray tube for developing a tube-current signal representative of the magnitude of the tube current. Means are coupled to the tube current sensing means and are responsive to the tube-current signal for generating a filament current control signal. Filament current control means are coupled between the filament current control signal generating means and the circuit means and are responsive to the filament current control signal for regulating the amount of current passing through the filament, whereby the filament current is automatically adjusted in accordance with the magnitude of the tube current to maintain the tube current at a predetermined level.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by the reference to the following description taken in connection with the accompanying drawings, in the several figures of which like reference numerals identify like elements, and in which:

DESCRIPTION OF THE PREFERRED EMBODIMENT

Figure 1:
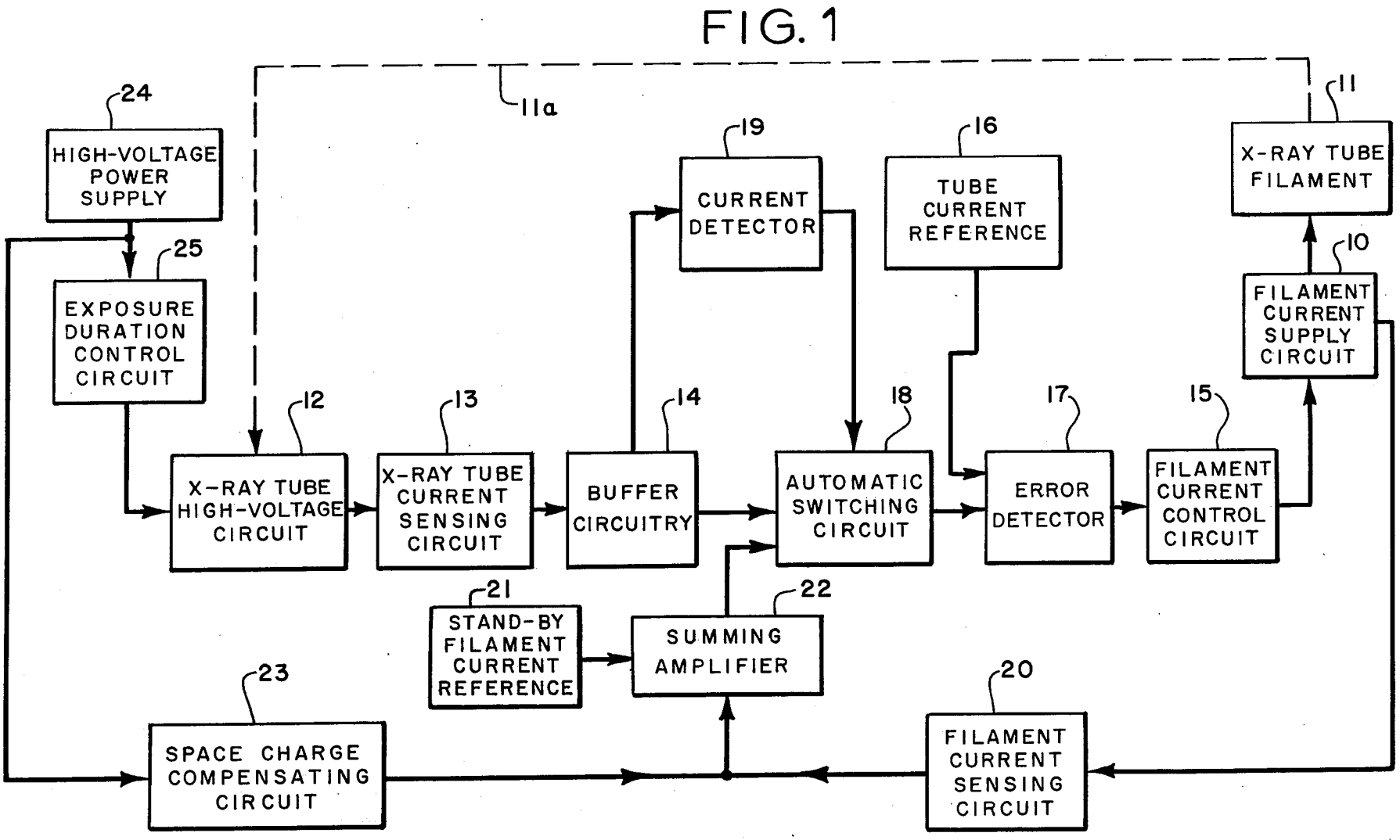
FIG. 1 is a block diagram of the electronic circuitry of a preferred embodiment of an automatic control system construction in accordance with the present invention.

With reference to FIG. 1, there is shown in block diagram form an automatic control system for regulating the emission of an X-ray tube of the type which is activated by the heating of a cathode filament 11 by passing current through filament 11. The X-ray tube itself forms no part of the present invention and, in order to simplify the drawings and thereby facilitate the understanding of the invention, the X-ray tube structure is not shown. Circuit means in the form of a filament circuit supply 10 are utilized for passing current through the X-ray tube filament 11. The current passing through the X-ray tube filament 11, in conjunction with the high voltage applied between the anode and cathode of the tube by an X-ray tube high-voltage circuit 12, determines the amount of current flowing between the anode and cathode of the X-ray tube. This tube current is sometimes referred to as "MA" and is directly proportional to the amount of X-ray emission generated by the X-ray tube.

In accordance with the invention, tube current sensing means in the form of an X-ray tube current sensing circuit 13 is coupled to the X-ray tube by means of X-ray tube high-voltage circuit 12 for developing a tube current signal representative of the magnitude of the current flowing between the anode and cathode of the X-ray tube. Suitable buffer circuitry 14 may be employed following the X-ray tube current sensing circuit 13 to provide an interface (e.g., impedance matching) with the remainder of the circuitry of the system. Means in the form of operational filament current reference 16 and an error detector 17 are coupled to X-ray tube current sensing circuit 13 and are responsive to the tube current signal for generating a filament current control signal. A filament current control circuit 15 is coupled between error detector 17 and filament current supply circuit 10 and is responsive to the filament current control signal generated by error detector 17 for regulating the amount of current passing through the filament, whereby the filament current is automatically adjusted in accordance with the magnitude of the tube current to maintain the tube current as a predetermined level.

In the embodiment of the invention illustrated in FIG. 1, the filament current control means also includes a tube current reference means 16 for generating a predetermined reference tube current signal and difference sensing means in the form of an error detector 17 which is responsive to the tube current signal and the reference tube current signal for developing a difference signal which corresponds to the filament current control signal and is applied to filament current control circuit 15.

In accordance with one feature of the illustrated embodiment of the present invention, the tube current signal from buffer circuitry 14 is applied to error detector 17 by switching means in the form of an automatic switching circuit 18. A current detector 19 is coupled to the X-ray tube by way of buffer circuitry 14 for generating a switching signal in response to the flow of tube, current through the X-ray tube, as sensed by X-ray tube current sensing circuit 13. Automatic switching circuit 18 is thus coupled between X-ray tube current sensing circuit 13 and error detector 17 and is responsive to the switching signal from current detector 19 for selectively applying the tube current signal to filament current control circuit 15 by way of error detector 13 whereby the filament circuit of the X-ray tube is automatically switched from a standby mode to an automatic regulation, operational mode when tube current flows in the X-ray tube.

When the tube is in the standby mode, any conventional circuit may be used to pass current through filament 11 to raise its temperature to the normal operating range or at least close thereto. In accordance with another feature of the invention, however, an improved standby filament current control system may be achieved by employing current monitoring means in the form of a filament current sensing circuit 20, which is coupled to the filament by means of filament current supply circuit 10, for sensing the amount of current flowing through the filament and developing a corresponding filament current monitor signal. Standby reference means in the form of standby filament current reference 21 are provided for generating a predetermined standby filament current reference signal which is applied to a summing amplifier 22, along with the filament current monitor signal from filament current sensing circuit 20. Summing amplifier 22 combines the filament current monitor signal with the standby filament current reference signal and generates a corresponding standby filament current control signal which is applied to automatic switching circuit 18. Thus when automatic switching circuit 18 is in the standby switching state, the standby filament current control signal from summing amplifier 22 is applied to error detector 17 to regulate the filament current to flow at a predetermined level prior to actuation of the X-ray tube to generate X-rays. On the other hand, when automatic switching circuit 18 is switched to the operational switching state by the switching signal from current detector 19, the standby filament current control signal is removed from error detector 17 and the tube current signal is applied to error detector 17 instead. Of course a manual switch could be substituted for current detector 19 and automatic switching circuit 18 to selectively regulate the filament current in the standby mode and operational mode in those embodiments of the invention where automatic switching is not desired. Thus, the system of the illustrated embodiment of the invention automatically switches from a standby mode, in which the filament current is regulated to maintain a predetermined standby value, to the operational mode in which the filament current is regulated to maintain a predetermined operational value.

In accordance with another feature of the illustrated embodiment of the invention, a space charge compensating circuit 23 is provided to compensate for the space charge effect which develops during tube warmup (i.e., heating the cathode to the desired operating temperature) to reduce the warmup time for the X-ray tube. The X-ray tube (not shown) includes means in the form of a high voltage power supply circuit 24 for generating the relatively high anode-cathode voltage required to operate the X-ray tube. An exposure duration control circuit 25 enables application of the high voltage to X-ray tube high-voltage circuit 12 for a specified period of time.

Exposure duration control circuit 25 may be of any conventional construction, the particular details of which form no part of the present invention. The space charge compensating circuit 23 is coupled between high-voltage power supply 24 and summing amplifier 22, and is responsive to the high-voltage signal generated by high-voltage power supply 24, for generating a corresponding space charge compensating signal which is applied to summing amplifier 22 at the same input terminal as the filament current monitor signal from filament current sensing circuit 20. The space charge effect is non-linear with respect to the magnitude of the high-voltage signal (typically measured in kilovolts) so the space charge compensating signal generated by space charge compensating circuit 23 is made correspondingly non-linear with respect to the magnitude of the high-voltage signal. As discussed hereinafter in greater detail with respect to FIGS. 2*a* and 2*b*, one particular construction of space charge compensating circuit 23 may include an incandescent lamp and a phototransistor. Thus, in accordance with this aspect of the invention, the space charge compensating signal is summed with the filament current monitor signal and the standby filament current reference signal to obtain the desired standby filament current signal for application to filament current control circuit 15, by way of automatic switching circuit 18 and error detector 17. With this circuit, the filament current of the X-ray tube is regulated during standby to compensate for the space charge effect and thus reduce the warmup time for the X-ray tube.

As set forth hereinabove, FIGS. 2*a* and 2*b* together illustrate an electrical schematic diagram of the electronic circuitry of a preferred embodiment of the invention. Approximately half of the circuit appears in FIG. 2*a* and the other half in FIG. 2*b*, with the appropriate interconnections being designated "A", "B", "C", "D", "E", "F", and "G". The circuit diagram has been drawn in this manner to simplify the drawings and thereby facilitate an understanding of the invention. The circuit illustrated in *FIGS.* 2*a* and 2*b* is a preferred embodiment of an automatic control system for regulating the emission of an X-ray tube (not shown) of the type in which current is passed through the cathode filament 210 to heat the cathode sufficiently to release electrons when a suitable high voltage is applied between the anode 211 and the cathode to attract the cathode electrons to the anode and thereby generate the emission of X-rays. Although in some embodiments of the invention, the cathode and filament may be separate elements of the X-ray tube, in the illustrated embodiment of the invention, cathode filament 210 is also the cathode of the tube. Means for supplying the high voltage to the tube include a pair of secondary transformer windings 212 which are driven by suitable high-voltage primary windings (not shown). Because the particular means for generating the high-voltage signal forms no part of the present invention and may be of any conventional design, it is not illustrated or discussed in greater detail.

Tube current sensing means in the form of a fullwave diode bridge 215 and a center-tapped resistor 216, the center tap of which is connected to ground, are coupled to the X-ray tube by means of high-voltage secondary windings 212 and their associated circuitry and develop a tube current signal representative of the magnitude of the current flowing from cathode 210 to anode 211. It is understood that, although the electrons actually travel from cathode 210 to anode 211, by convention the tube current is said to flow in the opposite direction. The tube current signal is available at terminal C and is utilized in the manner which is discussed hereinbelow.

Figure 2A:
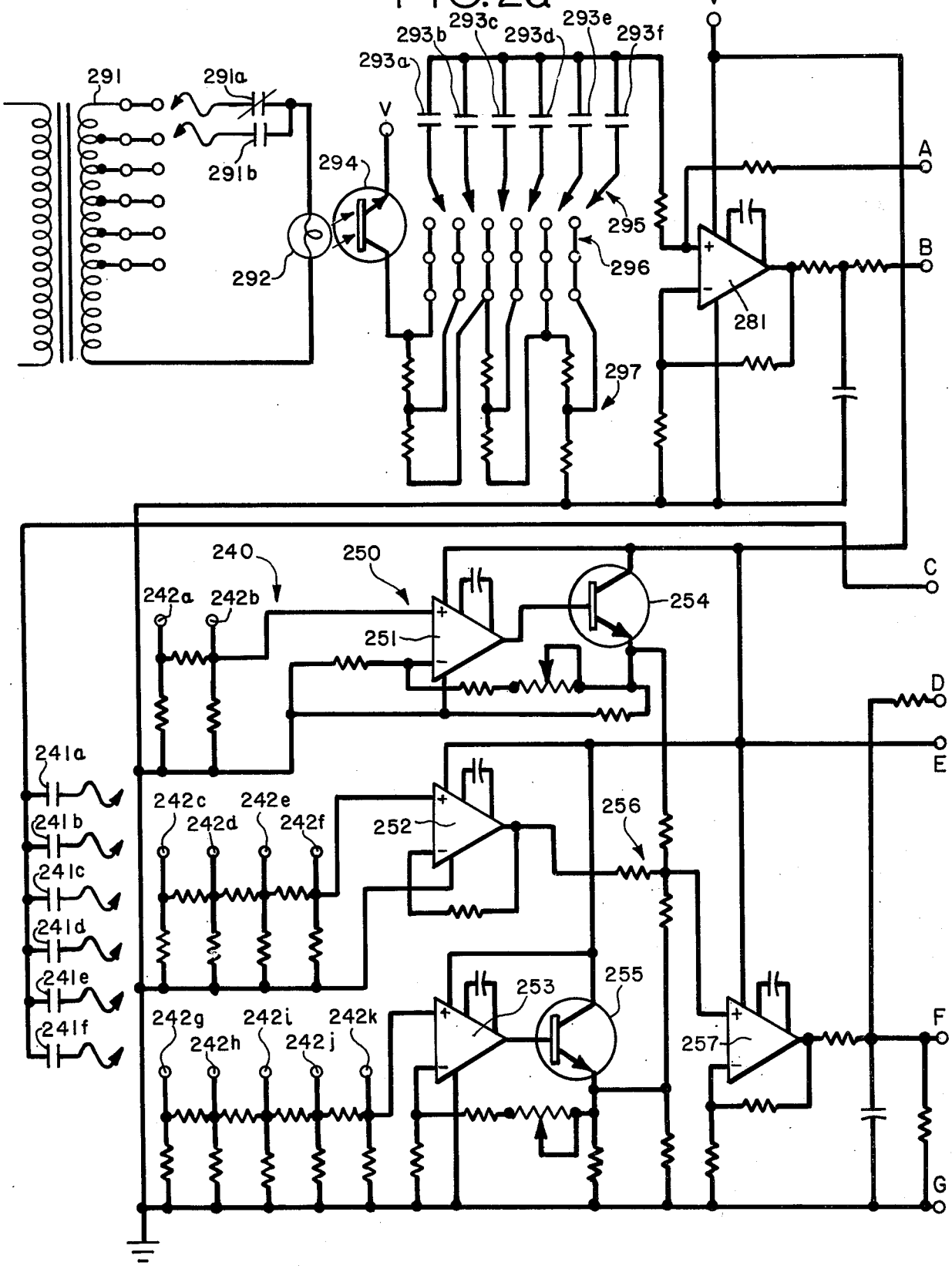
FIGS. 2*a* and 2*b* are an electrical schematic diagram of the electronic circuitry of a preferred embodiment of the invention.
Figure 2B:
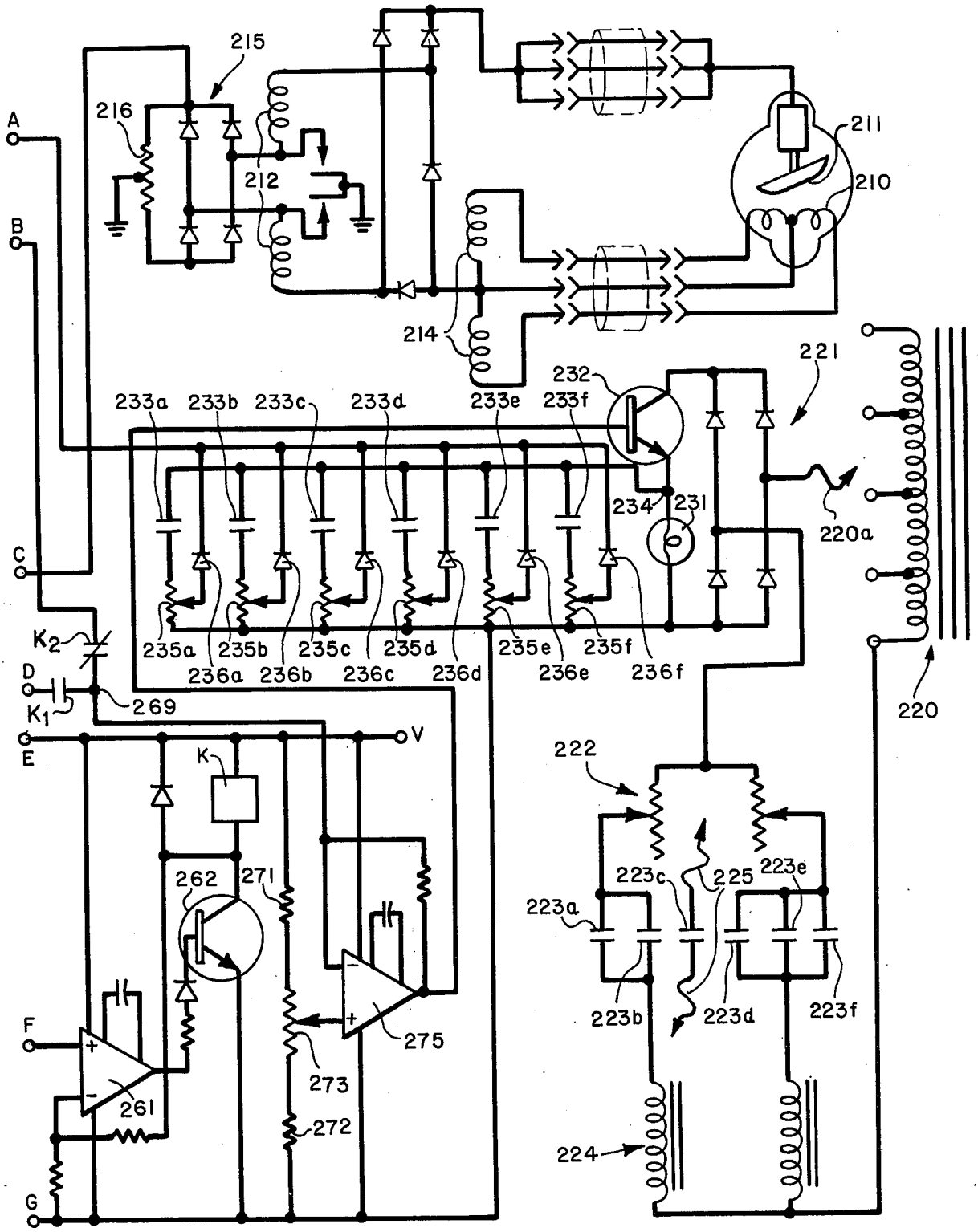

Circuit means in the form of a variable-tap autotransformer 220; full-wave diode rectifier circuit 221; a pair of variable resistors 222; relay contacts 223*a*, 223*b*, 223*c*, 223*d*, 223*e*, and 223*f*; and a pair of primary transformer windings 224 which correspond to secondary transformer windings 214 of the high-voltage circuit in FIG. 2*b*, are employed to pass current through filament 210. A jumper 220*a* is used to select the tap on autotransformer 220 which provides the desired operating range of supply voltage. Adjustable resistors 222 provide a means for reducing the voltage to the primary windings 224 to limit the amount of current supplied thereto. Relay contacts 223*a*–223*f*, together with a pair of jumper wires 225, enable the system to be programmed for different levels of filament current, as desired for the particular embodiment of the invention employed.

Filament current monitoring means in the form of an incandescent lamp 231 and an NPN transistor 232 are connected in a series with each other as shown and coupled to filament 210 by means of the filament current supply circuit including diode rectifier circuit 221 for sensing the amount of current flowing through the filament and developing a corresponding filament current monitor signal which is available at terminal 234. A plurality of relay contacts 233*a* through 233*f* and a corresponding plurality of potentiometers 235*a* through 235*f* are employed to couple the filament current monitor signal to an operational amplifier 281, as hereinafter described in greater detail. A corresponding plurality of diodes 236*a* through 236*f* are used as shown in FIG. 2*b* to prevent current flow in the reverse direction and thus protect transistor 232 from spurious or transient voltage spikes.

The filament current monitor signal is applied to a plurality of constant impedance input networks 240 by means of a plurality of relay contact pairs 241*a* through 241*f*, each of which pairs has one contact connected in common with the others and the other contact connected to an associated jumper wire. The jumper wires permit connection to selected ones of terminals 242*a* through 242*k*, depending upon the particular tube current ranges desired. For example, the jumper associated with relay contact pair 241*a* may be connected to terminal 242*e* to provide a current of 150 milliamps, the jumper associated with relay contact pair 241*b* may be connected to terminal 242*a* to provide a current of 500 milliamps, and so forth. The number of such terminals and relay contact pairs etc. may of course be varied depending upon the particular application for which the invention is practiced and the jumpers are typically connected to the desired terminals at the factory but may be changed later in the field if desired.

The output signals from the constant input impedance networks 240 are applied to buffer circuitry 250 which, in the embodiment of the invention illustrated in FIG. 2*a*, comprises a trio of operational amplifiers 251, 252, and 253. Operational amplifiers 251, 252, and 253, as well as the other operational amplifiers employed in the embodiment of the invention illustrated in FIGS. 2*a* and 2*b*, may be of any suitable type although one commonly known as a "LM308N" manufactured by National Semiconductor Corporation has been found especially well suited for this application. The output signals from operational amplifiers 251, 252, and 253 are adjusted by means of a pair of amplifying transistors 254, 255 and a resistor network 256 and then applied to the noninverting input of a preamplifier 257.

The output of preamplifier 257 of FIG. 2*a* is applied via terminal F to the non-inverting input of current detector means in the form of an operational amplifier 261 and is responsive to the tube current signal from preamplifier 257 for developing a switching signal. The switching signal is applied to a relay K by means of a switching transistor 262 and its associated circuitry to thus close a pair of normally-open relay contacts K1 and open a pair of normally-closed relay contacts K2 to thereby selectively apply to the output terminal 269 either the tube current signal from preamplifier 257 or a standby filament current control signal from operational amplifier 281, as discussed hereinafter in greater detail.

A reference current signal generating means for generating a predetermined reference tube current signal is provided in the embodiment of FIG. 2*b* in the form of a voltage source V and a voltage divided network comprising two fixed resistors 271 and 272 connected in series and on opposite sides of a potentiometer 273. Potentiometer 273 is used to adjust the voltage (i.e., the reference tube current signal) applied to the non-inverting input of an operational amplifier 275 which is used as a difference sensing means for comparing the signal at output terminal 269, which is applied to the inverting input of operational amplifier 275, with the reference tube current signal and generating a corresponding filament current control signal at the output of operational amplifier 275.

When tube current is flowing through the X-ray tube, detector amplifier 61 senses the tube current and develops a switching signal which switches relay K to close contacts K1, thereby applying the tube current signal from preamplifier 257 to output terminal 269, and open a pair of normally-closed contacts K2, thereby removing from output terminal 269 the standby filament current control signal from operational amplifier 281. When no tube current is flowing through the X-ray tube, no switching signal is generated and hence relay contacts K1 are open and relay contacts K2 are closed. This results in the amplification of the standby filament current control signal being applied to output terminal 269 to cause operational amplifier 275 to generate a filament current control signal which maintains the filament current at the desired standby level.

The standby filament current control signal is generated by summing amplifier means in the form of an operational amplifier 281 which has applied to its non-inverting input terminal a standby reference current signal, a filament current monitor signal, and a space charge compensating circuit signal to generate a standby filament current control signal at the output of summing amplifier 281. The filament current monitor signal is obtained as previous described from lamp 231 and the standby filament current reference signal is obtained by adjusting potentiometers **235*a*–235*f*, through which the filament current monitor signal is applied to the non-inverting input of operational amplifier 281. Each potentiometer 235*a*–235*f* is individually adjusted to provide the desired standby filament current reference level associated with the desired tube current and selected by means of the various relay contacts 233*a*–233*f*** sometimes referred to as "station" contacts.

In addition to the filament current monitor signal and the standby filament current reference signal, a space charge compensating signal is also applied to the non-inverting input of operational amplifier 281. This signal is developed by space charge compensating means in the form of a variable-tap transformer secondary 291, incandescent lamp 292, a phototransistor 294, a plurality of relay or "station" contacts **293*a*–293*f*, and an associated plurality of jumpers 295 which may be used to couple the relay contacts 293*a*–293*f* to a plurality of terminals 296 which in turn are coupled to a resistance network 297. The tapped transformer secondary 291 develops increasing voltages as the high voltage applied to the X-ray tube increases, with the two pairs of relay contacts 291*a* and 291*b* being utilized to provide a high- and low-voltage range selection. Incandescent lamp 292 is connected in series with the voltage taps to give off illumination which is responded to by phototransistor 294 to vary the voltage on the resistance networks 297. Since the space charge effect is non-linear with respect to the magnitude of the high voltage applied to the X-ray tube, advantage may be taken from the fact that the intensity of the light emitted from incandescent lamp 292 is also non-linear in a manner which closely approximates the inverse of the non-linearity of the space charge effect. In other words, as the magnitude of the high voltage applied to the X-ray tube is increased, the filament current decreases in a non-linear fashion, whereas as the voltage applied across incandescent lamp 292 increases, the light output thereof (particularly in the infrared region) increases in a non-linear fashion. Phototransistor 294, which may preferably be a photo-darlington transistor (commonly known as a 2N 5778 and manufactured by General Electric, for example), exhibits an excellent response to the red-infrared light region of the light emitted by incandescent lamp 292. As the light from lamp 292 increases, the phototransistors conduct more current and the resistive divider network 297 has an increasingly greater voltage drop, which voltage drop is used as the space charge compensating signal. It should be noted that station contacts 293*a*–293*f***, similar to the other station contacts throughout the circuit, may be controlled by relays (not shown), for example, to open and close certain station contacts simultaneously.

Thus the invention provides a new and improved system for automatically controlling the level of emission in an X-ray tube. The system automatically controls the emission by controlling the X-ray tube filament current, and thus the X-ray tube current, both prior to making an exposure and during the exposure itself. The system is not only relatively simple to operate and construct, but it precisely determines the X-ray tube current for each selected D.C. kilovoltage between anode 211 and cathode 212 used in the X-ray exposure. The kilovoltage is adjustable in accordance with known circuitry. Typically, an adjustable tap autotransformer supplies voltage to the primary of the high voltage transformer, the secondary voltage of which is rectified and then applied to the X-ray tube.

The system automatically compensates for changes in the values of filament circuit components such as the resistors, wires and other components which may change the values with age and/or temperature. Moreover, it automatically compensates for the changing of X-ray tube filament emission characteristics due to filament evaporation caused by aging in the fastest possible time. Tube current metering circuits may be eliminated.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

The invention is claimed as follows:

1. An automatic control system for regulating the emission of an X-ray tube of the type which is activated by the heating of a cathode filament by passing current through said filament, and which emits X-ray radiation systematically in accordance with the amount of tube current flowing between the anode and cathode of the tube, said system comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament; current detector means coupled to said X-ray tube for generating a switching signal in response to the flow of said tube current; said switching means coupled between said tube current sensing means and said filament current control signal generating means and responsive to said switching signal for selectively applying said tube current signal to said filament control signal generating means, whereby the filament circuit of the X-ray tube is automatically switched from a standby mode to an operational only mode when tube current flow in the X-ray tube.

2. An automatic control system for regulating the emission of an X-ray tube of the type which is activated by the heating of a cathode filament by passing current through said filament, and which emits X-ray radiation systematically in accordance with the amount of tube current flowing between the anode and cathode of the tube, said system comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament, current monitoring means coupled to said filament for sensing the amount of current flowing through said filament and developing a corresponding filament current monitor signal; standby reference signal generating means for generating a predetermined standby filament current reference signal; summing means responsive to said filament current monitor signal and said standby filament current reference signal for generating a corresponding standby filament current control signal; and switching means for selectively removing said tube current signal from said filament current control means and applying said standby filament current control signal to said filament current control means, said switching means including tube current detector means coupled to said tube current sensing means and responsive to said tube current signal for developing a switching signal, and further including means responsive to said switching signal for automatically removing said standby filament current reference signal from said filament current control means and applying said current control signal to said filament current control means, whereby the system automatically switches from standby filament current control to operational filament current control only when tube current flows in the X-ray tube.

3. An automatic control system for regulating the emission of an X-ray tube of the type which is activated by the heating of a cathode filament by passing current through said filament, and which emits X-ray radiation systematically in accordance with the amount of tube current flowing between the anode and cathode of the tube, said system comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament, current monitoring means coupled to said filament for sensing the amount of current flowing through said filament and developing a corresponding filament current monitor signal; standby reference signal generating means for generating a predetermined standby filament current reference signal; summing means responsive to said filament current monitor signal and said standby filament current reference signal for generating a corresponding standby filament current control signal; and switching means for selectively removing said tube current signal from said filament current control means and applying said standby filament current control signal to said filament current control means, said circuit means comprising a transformer having its primary winding connected to said filament current control means and its secondary winding connected to said filament; and said filament current monitoring means comprising an incandescent lamp connected in series with said primary winding, with said filament current monitor signal comprising the voltage developed across said lamp.

4. An automatic control system for regulating the emission of an X-ray of the type which is activated by the heating of a cathode filament by passing current through said filament, and which emits X-ray radiation systematically in accordance with the amount of tube current flowing between the anode and cathode of the tube, said system comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament, current monitoring means coupled to said filament for sensing the amount of current flowing through said filament and developing a corresponding filament current control monitor signal; standby reference signal generating means for generating a predetermined standby filament current reference signal; summing means responsive to said filament current monitor signal and said standby filament current reference signal for generating a corresponding standby filament current control signal; and switching means for selectively removing said tube current signal from said filament current control means and applying said standby filament current control signal to said filament current control means, means for generating and applying a high voltage between said anode and said cathode; space charge compensating means coupled between said high-voltage generating means and said summing means and responsive to said high-voltage signal for generating a corresponding space charge compensating signal and applying it to said summing means, in which said space charge compensating means includes an incandescent lamp connected to said high voltage generating means and a phototransistor responsive to the radiation from said lamp for generating said space charge compensating signal.

5. An automatic control system for regulating the emission of an X-ray tube of the type which is activated by the heating of a cathode filament by passing current through said filament, and which emits X-ray radiation systematically in accordance with the amount of tube current flowing between the anode and cathode of the tube, said system comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament; said filament current control means comprising a full-wave rectifier circuit and a transistor connected in series with said filament current, with said filament current control signal being applied to the base of said transistor.

6. An automatic control system for regulating the emission of an X-ray tube of the type which current is passed through a cathode filament to heat the cathode sufficiently to release electrons, and in which a high voltage is applied between the anode and the cathode to attract the cathode electrons to the anode and thereby develop a tube current which generates the emission of X-rays systematically in accordance with the magnitude of said tube current, said system comprising: means for generating and applying said high voltage between said cathode and anode to develop a high anode-to-cathode voltage signal; tube current sensing means coupled to said X-ray tube for developing a tube current signal representative of the magnitude of the tube current flowing between said cathode and said anode; circuit means for passing current through said filament; filament current monitoring means coupled to said filament for sensing the amount of current flowing through said filament and developing a corresponding filament current monitor signal; first reference current signal generating means for generating a predetermined standby filament current reference signal; summing amplifier means responsive to said filament current monitor signal and said standby filament current reference signal for generating a corresponding standby filament current control signal; second reference current signal generating means for generating a predetermined reference tube current signal; current detector means coupled to said tube current sensing means and responsive to said tube current signal for developing a switching signal; switching means, including an output terminal, coupled to said tube current sensing means and said summing amplifier and responsive to said switching signal for selectively applying to said output terminal said tube current signal and said standby filament current control signal; difference sensing means coupled to said second reference current signal means and said output terminal of said switching means for comparing the signal at said output terminal with said reference tube current signal and generating a corresponding filament current control signal; and filament current control means coupled between said difference sensing means and said circuit means and responsive to said filament current control signal for regulating the amount of current flowing through said filament, whereby the filament current is automatically regulated to maintain a predetermined temperature of the cathode both prior to and during the generation of X-rays to thus cause the X-ray tube to be rendered operational quickly and efficiently as well as control the tube current of the X-ray tube to maintain a desired level of X-ray emission.

7. An automatic control system in accordance with claim 6, which further comprises space charge compensating means coupled between said high-voltage signal generating means and said summing amplifier means and responsive to said high-voltage signal for generating a corresponding space charge comprising signal and applying it to said summing amplifier means, whereby the filament current of the X-ray tube is regulated to compensate for the space charge effect and thus reduce the warm-up time for the X-ray tube.

8. An automatic control system in accordance with claim 7, in which said space charge compensating means includes an incandescent lamp connected to said high voltage signal generating means; and a phototransistor responsive to the radiation from said lamp for generating said space charge compensating signal.

9. An X-ray apparatus comprising an X-ray tube of the type which is activated by the heating of a cathode filament by passing current through said filament, and which emits X-ray radiation systematically in accordance with the amount of tube current flowing between the anode and cathode of the tube, means for applying a selective kilovoltage between said anode and cathode to provide an X-ray exposure, and control means for regulating the X-ray emission from the tube so as to maintain a predetermined current flowing between said anode and said cathode during said exposure, said control means comprising: circuit means for passing current through said filament; tube current sensing means coupled to said X-ray tube for developing a tube current signal representative of the magnitude of said tube current; means coupled to said tube current sensing means and responsive to said tube current signal for generating a filament current control signal; filament current control means coupled between said filament current control signal generating means and said circuit means and responsive to said filament current control signal for regulating the amount of current passed through said filament, whereby the filament current is automatically adjusted to maintain said tube current at a known level for a selected kilovoltage used in the exposure; current detector means coupled to said X-ray tube for generating a switching signal in response to the flow of said tube current; and switching means coupled between said tube current sensing means and said filament current control signal generating means and responsive to said switching signal for selectively applying said tube current signal to said filament control signal generating means, whereby the filament circuit of the X-ray tube is automatically switched from a standby mode to an operational mode when tube current flows in the X-ray tube.

* * * * *

UNITED STATES PATENT AND TRADEMARK OFFICE

CERTIFICATE OF CORRECTION

PATENT NO. : 4,072,865
DATED : FEBRUARY 7, 1978
INVENTOR(S) : JAMES R. CRAIG and STEVEN F. NERGE It is certified that error appears in the above-identified patent and that said Letters Patent are hereby corrected as shown below:

Column 3, line 22, "as" should be --at--;

Column 6, line 57, "divided" should be --divider--;

Column 7, line 2, "amplifier 61" should be --amplifier 261--;

Column 12, line 10, "comprising" should be --conpensating--

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*